US010292423B2

(12) United States Patent
McFarlane et al.

(10) Patent No.: US 10,292,423 B2
(45) Date of Patent: May 21, 2019

(54) SMOKELESS TOBACCO CONTAINER

(71) Applicant: JT International S.A., Geneva (CH)

(72) Inventors: Mary Wilhelmina McFarlane, Limavady (IE); Leanne Delargy, Cushendall (IE)

(73) Assignee: JT International SA (CH)

( * ) Notice: Subject to any disclaimer, the term of this patent is extended or adjusted under 35 U.S.C. 154(b) by 0 days.

(21) Appl. No.: 15/537,286

(22) PCT Filed: Dec. 16, 2015

(86) PCT No.: PCT/EP2015/080035
§ 371 (c)(1),
(2) Date: Jun. 16, 2017

(87) PCT Pub. No.: WO2016/097007
PCT Pub. Date: Jun. 23, 2016

(65) Prior Publication Data

US 2017/0340006 A1 Nov. 30, 2017

(30) Foreign Application Priority Data

Dec. 19, 2014 (EP) ..... 14199462

(51) Int. Cl.

| | |
|---|---|
| ***A24F 15/00*** | (2006.01) |
| ***B65D 85/10*** | (2006.01) |
| ***B65D 85/12*** | (2006.01) |
| ***A24F 23/02*** | (2006.01) |
| ***A24F 23/00*** | (2006.01) |
| ***B65D 25/10*** | (2006.01) |
| ***B65D 43/02*** | (2006.01) |

(52) U.S. Cl.
CPC ..... *A24F 23/02* (2013.01); *A24F 23/00* (2013.01); *B65D 25/10* (2013.01); *B65D 43/0202* (2013.01)

(58) Field of Classification Search
CPC ..... A24F 23/02; A24F 23/00; B65D 25/10; B65D 43/0202
USPC ..... 206/236, 242–275, 813; 131/112, 119, 131/180; 220/592.01; 211/12
See application file for complete search history.

(56) References Cited

U.S. PATENT DOCUMENTS 5,040,674 A * 8/1991 Bragin ..... A47B 87/0269 206/242
5,960,957 A * 10/1999 Johnson ..... A47F 5/03 206/338

(Continued)

FOREIGN PATENT DOCUMENTS

| | | |
|---|---|---|
| EP | 2543610 A1 | 1/2013 |
| GB | 904628 A | 8/1962 |
| WO | 2013174991 A1 | 11/2013 |

OTHER PUBLICATIONS

International Search Report for Application No. PCT/EP2015/080035 dated Mar. 22, 2016.

*Primary Examiner* — Rafael A Ortiz
(74) *Attorney, Agent, or Firm* — Lerner, David, Littenberg, Krumholz & Mentlik, LLP

(57) ABSTRACT

The present invention provides a container (1) for smokeless tobacco comprising a base defining a cavity arranged to retain smokeless tobacco pouches (8) in use, wherein the cavity further comprises a pole (5), arranged such that the smokeless tobacco pouches are retained in a defined pattern in use.

18 Claims, 14 Drawing Sheets

(56) References Cited

U.S. PATENT DOCUMENTS

| | | | | |
|---|---|---|---|---|
| 2007/0261707 | A1* | 11/2007 | Winterson | A24B 13/00 131/352 |
| 2012/0024301 | A1* | 2/2012 | Carroll | A24B 13/00 131/275 |
| 2015/0122675 | A1* | 5/2015 | Aspgren | A24F 23/00 206/236 |

* cited by examiner

SMOKELESS TOBACCO CONTAINER

CROSS-REFERENCE TO RELATED APPLICATIONS

The present application is a national phase entry under 35 U.S.C. § 371 of International Application No. PCT/EP2015/080035, filed Dec. 16, 2015, published in English, which claims priority from EP 14199462.4, filed Dec. 19, 2014, the disclosures of which are incorporated herein by reference.

FIELD OF THE INVENTION

The present invention relates to a container for smokeless tobacco pouches.

BACKGROUND TO THE INVENTION

There are various tobacco products that are termed "smokeless" tobacco products because they are used by means other than smoking. For example, snus is a heat-treated moist powder tobacco product that is typically consumed by placing it under the upper lip for extended periods of time. There are various types of snus available on the market. Loose snus is a moist powder which can be portioned and shaped prior to insertion into the mouth. Portion snus is pre-packaged in small sachets of porous non-woven material.

The standard retail packaging format for snus, and many other forms of smokeless tobacco, is a moulded, shallow, drum-shaped, lidded container, often made from plastics such as polypropylene. Other packaging formats include the use of metal or waxed cardboard or a combination such as metal lid and cardboard can.

One of the problems with packaging pouches of smokeless tobacco in conventional containers is that the pouches move around inside the container and can become deformed. This means that the user must adjust the shape of the pouch prior to use.

In addition, the irregular distribution of pouches within the container does not enable efficient use of the available space within the container and it can be difficult for user to judge how many pouches remain.

Furthermore, pouches come into contact with each other within the container, which results in staining on the exterior of the pouches. Since the exterior of the pouches is often white or light-coloured, this staining is and undesirable.

Therefore, there is a need for improved storage and presentation of smokeless tobacco pouches.

SUMMARY OF THE INVENTION

The present invention provides a container for smokeless tobacco comprising a base defining a cavity arranged to retain smokeless tobacco pouches in use, wherein the cavity further comprises a pole, arranged such that the smokeless tobacco pouches are retained in a defined pattern in use.

In a preferred embodiment at least two smokeless tobacco pouches are attached to the pole.

DETAILED DESCRIPTION OF THE INVENTION

Figure 1:
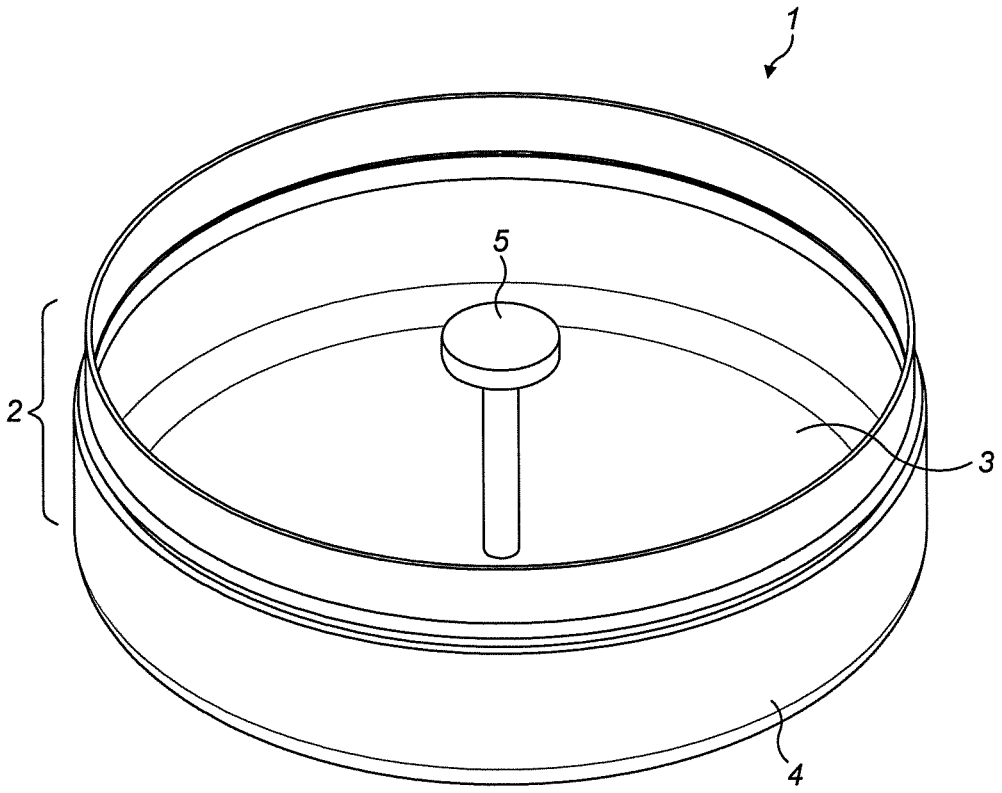
FIG. 1 shows an empty container according to the invention.

The term "smokeless tobacco" refers to a variety of tobacco products that are used by means other than smoking. These uses include chewing, sniffing, placing the product between the teeth and gum, and application to the skin. Types of smokeless tobacco include: dipping tobacco and snus (which are placed between the lower or upper lip and gums), chewing tobacco, snuff (which is inhaled into the nasal cavity), tobacco gum and dissolvable tobacco.

According to the present invention, a container for smokeless tobacco comprises a base defining a cavity arranged to retain smokeless tobacco pouches in use, wherein the cavity further comprises a pole, arranged such that the smokeless tobacco pouches are retained in a defined pattern in use.

The container may be any convenient size and shape, but in a preferred embodiment is drum-shaped. The base comprises a bottom portion and a cylindrical sidewall portion that is perpendicular to the bottom portion and extends around the circumference of the bottom portion. The container may be made of any suitable material, including wood, metal, plastic, cardboard or a combination of these materials.

In a preferred embodiment, the container comprises a lid, which may be made from the same material as the container or from a different material. The lid may comprise one or more indentations that facilitate removal of the lid by a consumer.

In a preferred embodiment, the bottom portion of the base and at least the lower portion of the sidewall portion have a constant thickness. The thickness of the upper portion of the sidewall may be reduced relative to the lower portion of the sidewall and the bottom portion, in order to facilitate a lid being positioned securely on top of the base.

In embodiments where the pole is hollow and is integral to the bottom portion of the base, the thickness of the pole is preferably equal to the thickness of the bottom portion and at least the lower portion of the sidewall. It is advantageous for the thickness of the bottom portion, at least the lower portion of the sidewalls, and the pole to be consistent, as this facilitates a simple and straightforward process for manufacturing the container of the invention.

The cavity defined by the base comprises a pole, which functions as a support about which the pouches are arranged when in use. The pole may be located centrally within the base, or may be positioned off-centre. Preferably the pole is located in the centre of the base. The pole can be integral to the bottom portion of the base, or it can be a separate component that this connected to the base by any suitable means. In a preferred embodiment the pole is integral to the bottom portion of the base.

The pole may be any suitable shape. In a preferred embodiment the pole is cylindrical. In an alternative preferred embodiment the pole is polygonal. The pole may be a solid structure, or it may be hollow (e.g. tubular or cylindrical). The pole may have a constant cross-sectional area, or the cross-sectional area may change along the length of the pole. For example, the pole may be wider at the top or wider at the bottom.

The pole may be adapted to enable attachment of pouches to the pole. The pole may comprise one or more holes, elongated slots or glued portions which enable the pouches to be attached to the pole, and detached by a consumer when in use. The holes and/or slots may be a variety of sizes and shapes, including circular, rectangular, triangular, elongated linear, 'W' shaped and 'M' shaped. The dimensions of the hole or slot may correspond to the cross-sectional dimensions of the pouch, so that the pouch, or an end portion thereof, can be inserted easily into the hole or slot.

The pole can be any convenient height, but its height should not extend beyond the height of the sidewall of the container. In embodiments wherein the container of the invention comprises a lid, the height of the pole should not be greater than the distance from the bottom portion of the base to the internal surface of the lid when the lid is positioned on top of the base. Preferably the height of the pole in the direction of the longitudinal axis of the pole is between 10 to 30 mm. Preferably, the surface area of the section of the pole in a plane perpendicular to the same axis is between 3 to 350 $mm^2$.

The pouches containing smokeless tobacco that are arranged inside the container of the invention may be in the form of a single continuous strip or a plurality of continuous strips each comprising multiple pouches, or may be individual pouches. If the pouches are provided as one or more continuous strips, the individual pouches are preferably separated by perforations which enable the user to remove individual pouches from the strip.

The pouches may be any convenient shape. In a preferred embodiment, the pouches are substantially triangular or rectangular in section (shown in FIG. 4), which enables the pouch to be inserted into the consumer's mouth, for example between the gum and upper lip, without the consumer having to adjust the pouch prior to use. In a preferred embodiment the shape of each pouch is rectangular, having major panels and side panels, wherein the major panels are contacted to each other and/or wherein the side panels are contacted to the base.

In an embodiment of the invention each smokeless tobacco pouch arranged inside the container comprises a pull tab. The pull tab extends around at least a portion of the pouch and enables the consumer to easily remove a pouch from the container by pulling on an exposed portion of the pull tab. This is advantageous because it facilitates removal of a single pouch without disturbing the other pouches arranged within the container.

The smokeless tobacco product contained within the pouches is preferably snus.

When the container of the invention is in use a plurality of tobacco pouches may be arranged about the pole and brought into contact with the pole without being physically attached to the pole. Alternatively, the pouches may be attached to the pole at one or more points. If the pole is polygonal in shape, the pouches may be attached to one or more surfaces of the polygon, and preferably the pouches are attached to each surface of the polygon. The pouches are attached to the pole by means which enable the consumer to remove each pouch from the pole when required without damaging or ripping the pouch, and retaining the integrity of the pouch such that the tobacco contents are not released. The pouches may be attached to the pole using glue, preferably food grade glue, such as starch. Alternatively or additionally, the pouches may be attached to the pole by inserting a portion of the pouch into a hole or slot in the surface of the pole.

The container of the present invention is advantageous because its enables the smokeless tobacco pouches to be held in a defined position within the container. This allows efficient use of the space within the container and allows the consumer to easily judge how many pouches remain. It is easy for the consumer to select and remove a single pouch, without disturbing the remaining pouches. Furthermore, the defined arrangement of pouches within the container prevents the pouches contacting each other, and consequently reduces staining on the exterior of the pouches.

The container of the invention will now be further defined by reference to the figures, which are intended to exemplify but not limit the invention.

FIG. 1 shows a container (1) comprising a base (2) defining a cavity. The base (2) comprises a bottom portion (3) and a sidewall portion (4), which is perpendicular to the bottom portion. The cavity comprises a pole (5). In the embodiment of the invention shown in this figure the pole is located centrally within the base.

Figure 2:
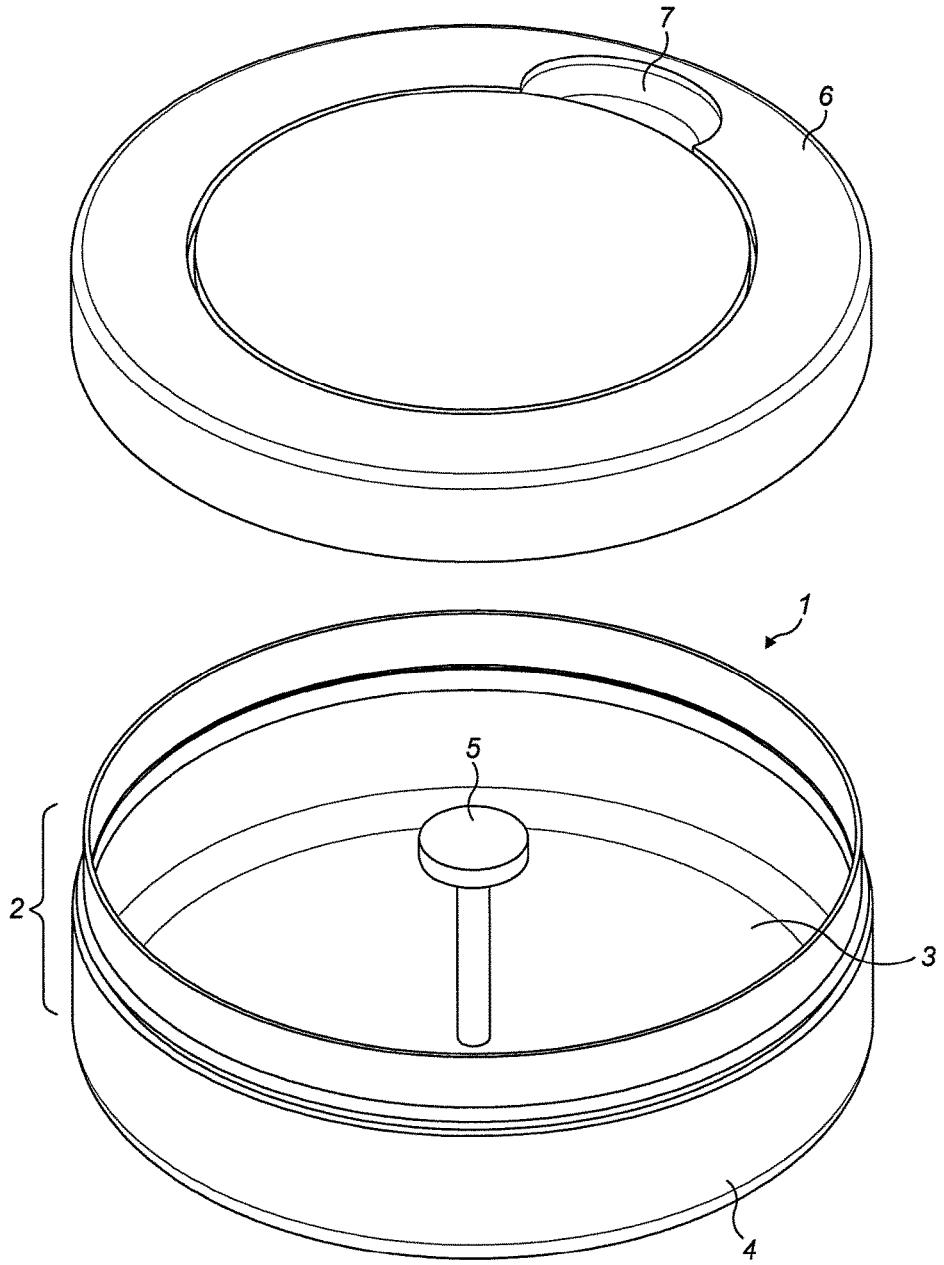
FIG. 2 shows an empty container according to the invention together with a lid.

FIG. 2 shows the container of FIG. 1, and additionally shows a separate lid portion (6). In use, the lid portion fits securely on top of the base (2) to ensure that the pouches arranged within the container remain in place. In the embodiment illustrated in this figure the lid (6) comprises an indentation (7) that facilitates removal of the lid by a consumer.

Figure 3:
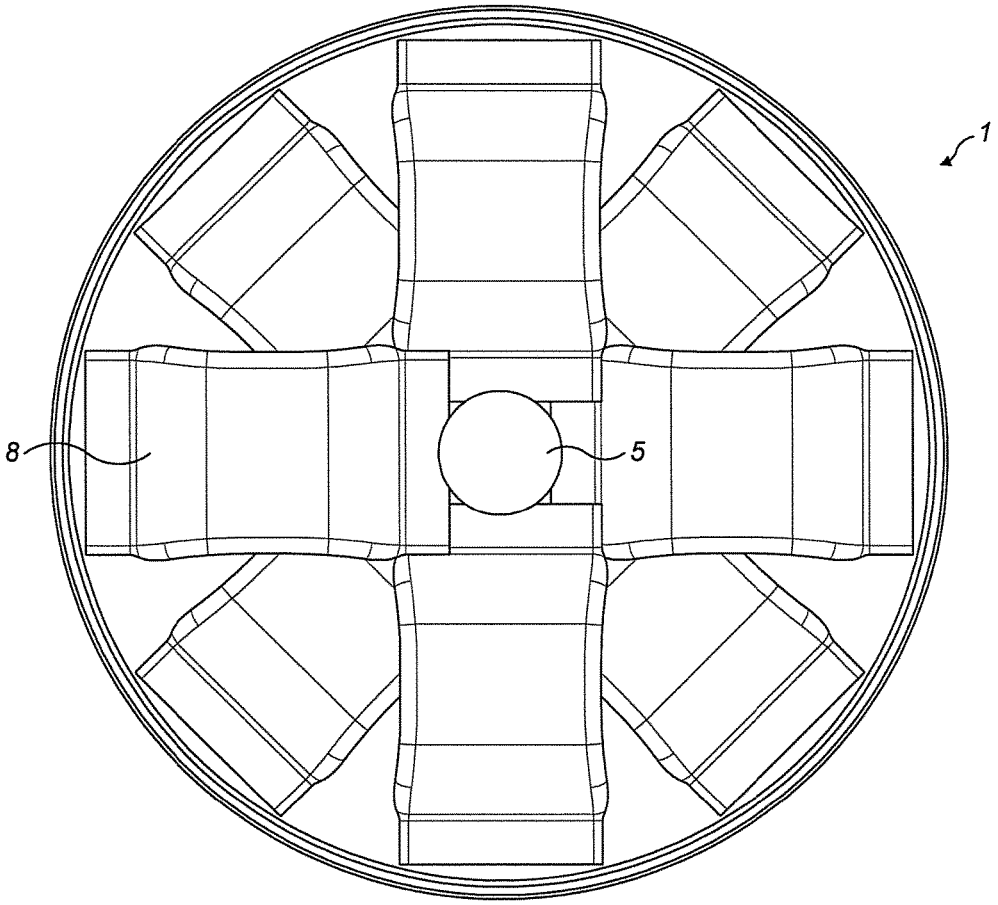
FIG. 3 shows a container according to the invention with individual smokeless tobacco pouches arranged about the pole in a flower formation.

FIG. 3 is a bird's-eye view of a container (1) with individual smokeless tobacco pouches (8) arranged about the pole (5) in a flower formation. The end of the pouch (8) in contact with the pole (5) may be attached to the pole (5) using glue, preferably food grade glue, such as starch, or via insertion into slots or holes in the surface of the pole (not shown). Alternatively, each pouch (8) is arranged about the pole (5) but it not physically attached to it.

Figure 4:
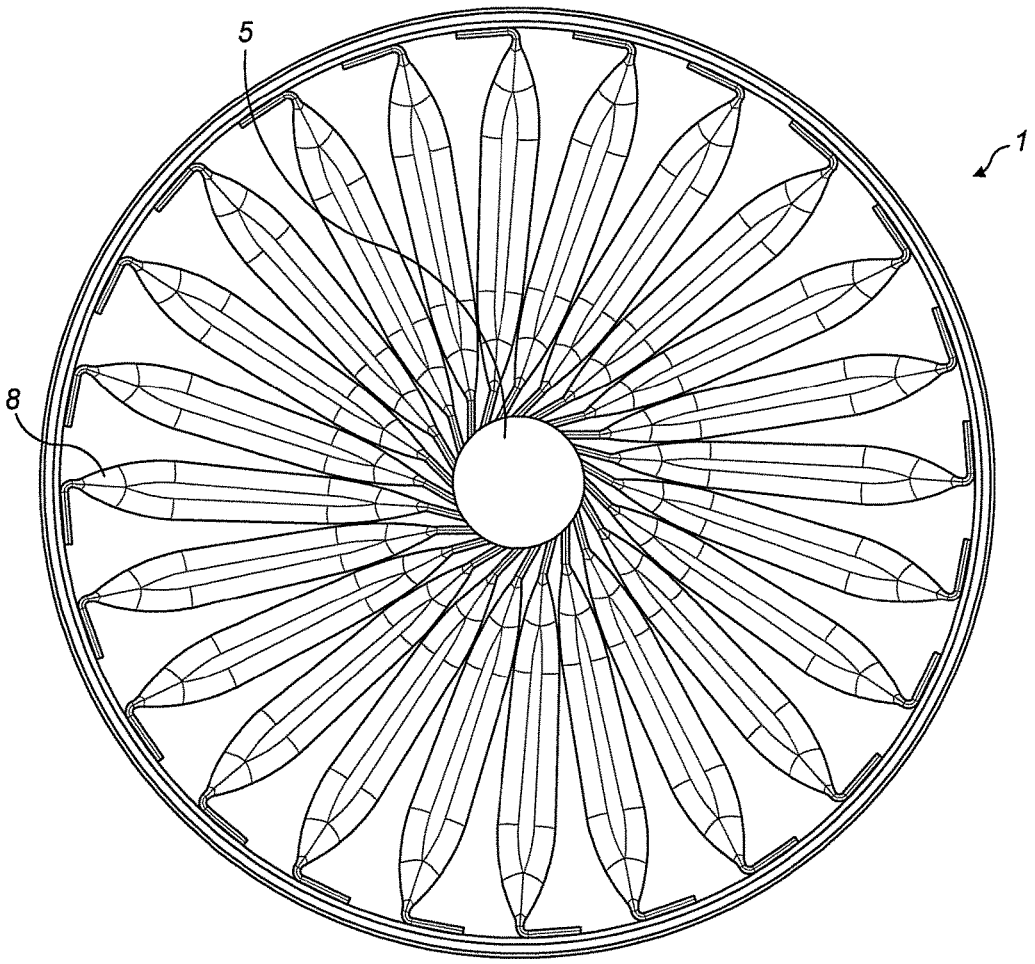
FIG. 4 shows a container according to the invention with individual smokeless tobacco pouches arranged about the pole in a radial formation.

FIG. 4 shows a container according to the invention with individual smokeless tobacco pouches (8) arranged about the pole (5) in a radial formation. The end of the pouch (8) in contact with the pole (5) may be attached to the pole (5) using glue, preferably food grade glue, such as starch, or via insertion into slots or holes in the surface of the pole (not shown). Alternatively, each pouch (8) is arranged about the pole (5) but it not physically attached to it.

Figure 5A:
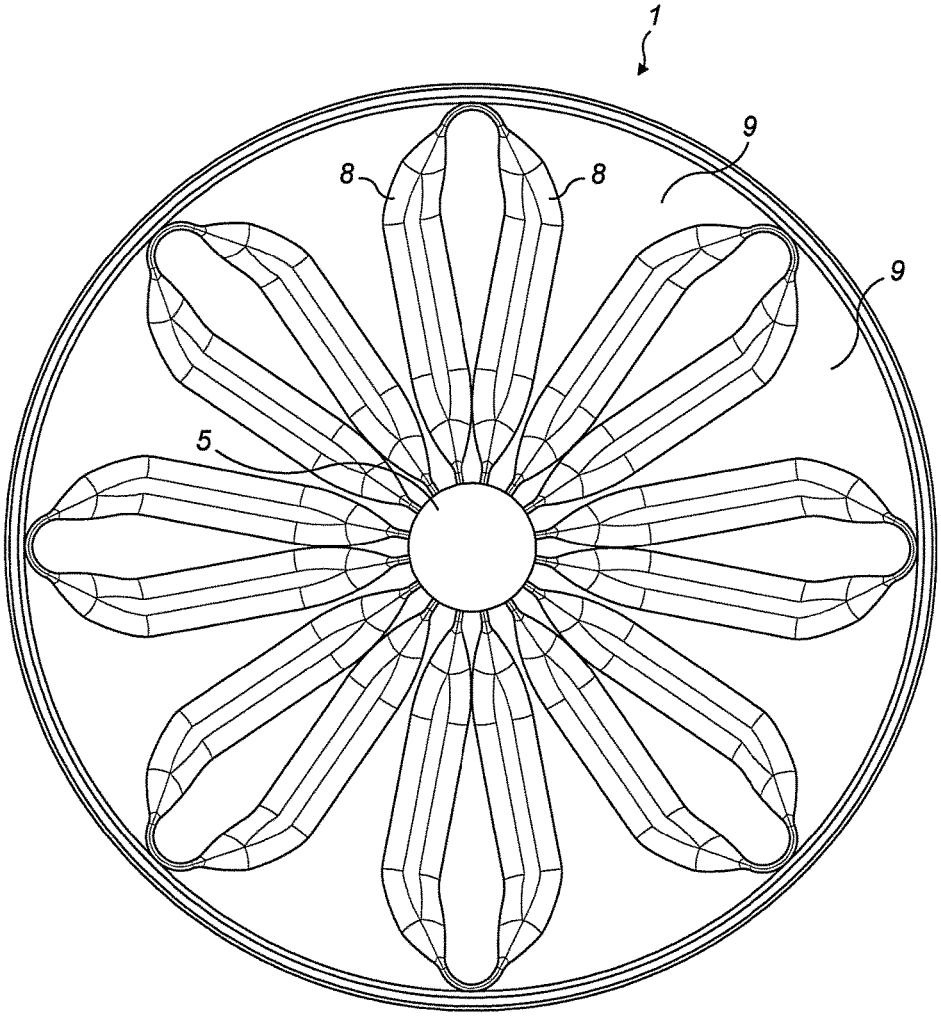
FIG. 5(A) shows a container according to the invention with continuous strip of smokeless tobacco pouches arranged about the pole and (B) shows a continuous strip of smokeless tobacco pouches.
Figure 5B:
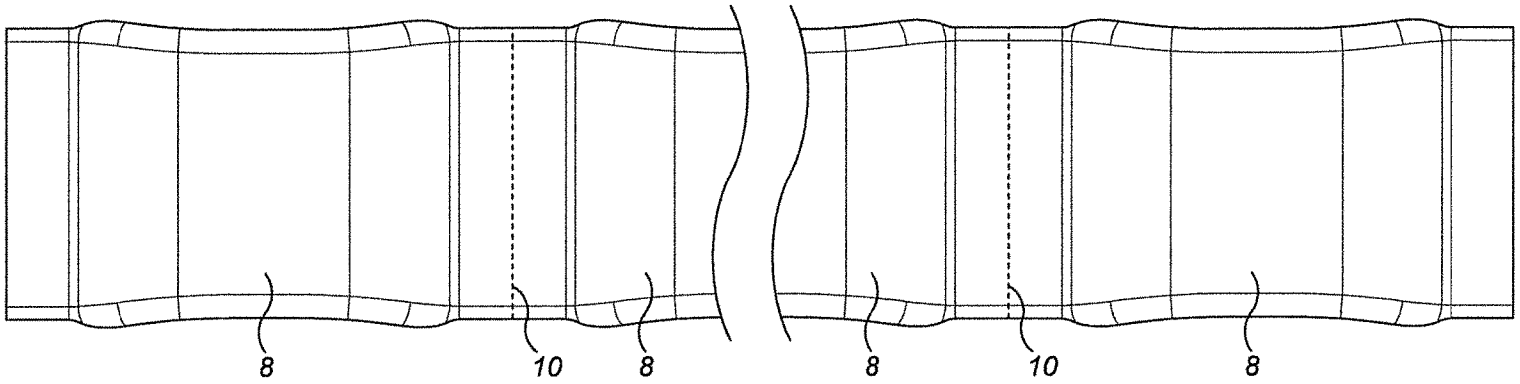

An embodiment of the invention wherein the smokeless tobacco pouches are provided as a plurality of continuous strips arranged about the pole is shown in FIG. 5(A). In this figure the container (1) contains eight strips (9), each strip consisting of two pouches (8) are shown arranged about the pole (5). FIG. 5(B) shows a continuous strip of smokeless tobacco pouches (8). The individual pouches are connected via perforations (10) which enable the user to remove individual pouches from the strip. Each continuous strip may be of any length, consisting of any convenient number of individual pouches.

Figure 6:
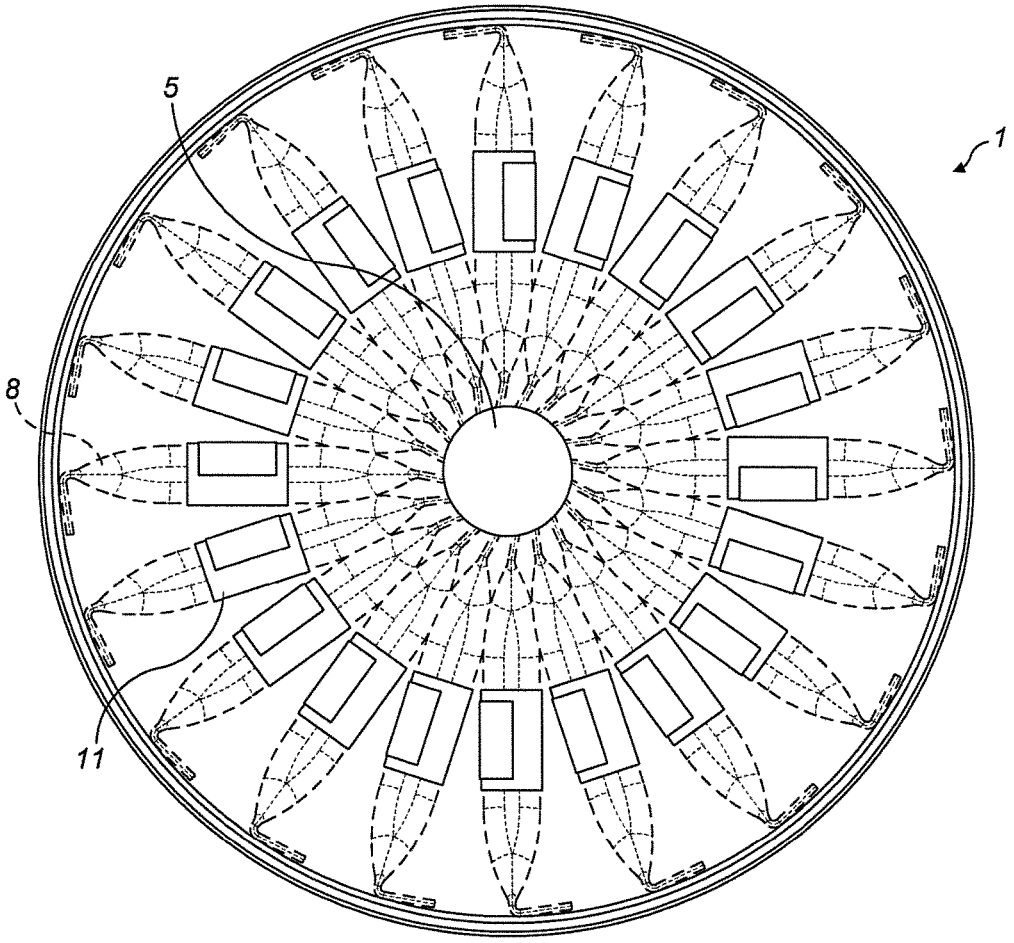
FIG. 6 shows a container according to the invention with smokeless tobacco pouches arranged about the pole and with a pull tab around each pouch.

In order to aid removal of pouches from the container of the invention when in use, each pouch may be provided with a pull tab. This embodiment of the invention is illustrated in FIG. 6. A container (1) comprises smokeless tobacco pouches (8) arranged about the pole (5) and a pull tab (11) extends around at least a portion of each pouch. In use, the consumer pulls on a pull tab to remove a single pouch form the container.

Figure 7:
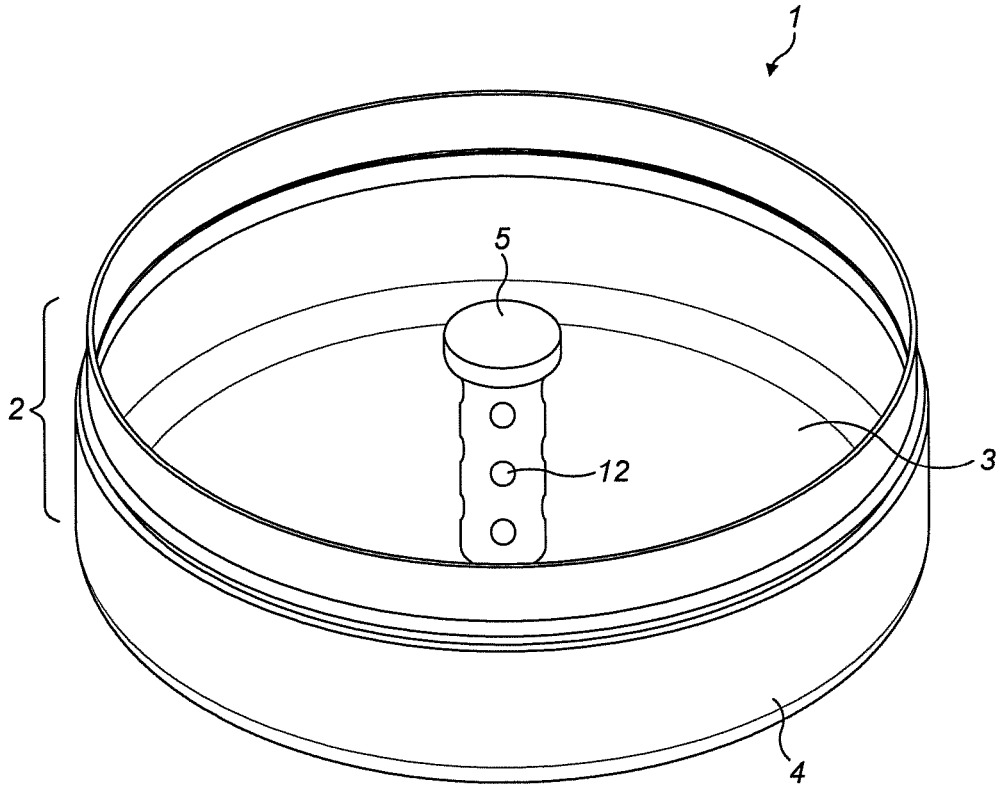
FIG. 7 shows an empty container according to the invention, wherein the pole has a plurality of holes in its surface to enable pouches to be attached.
Figure 8:
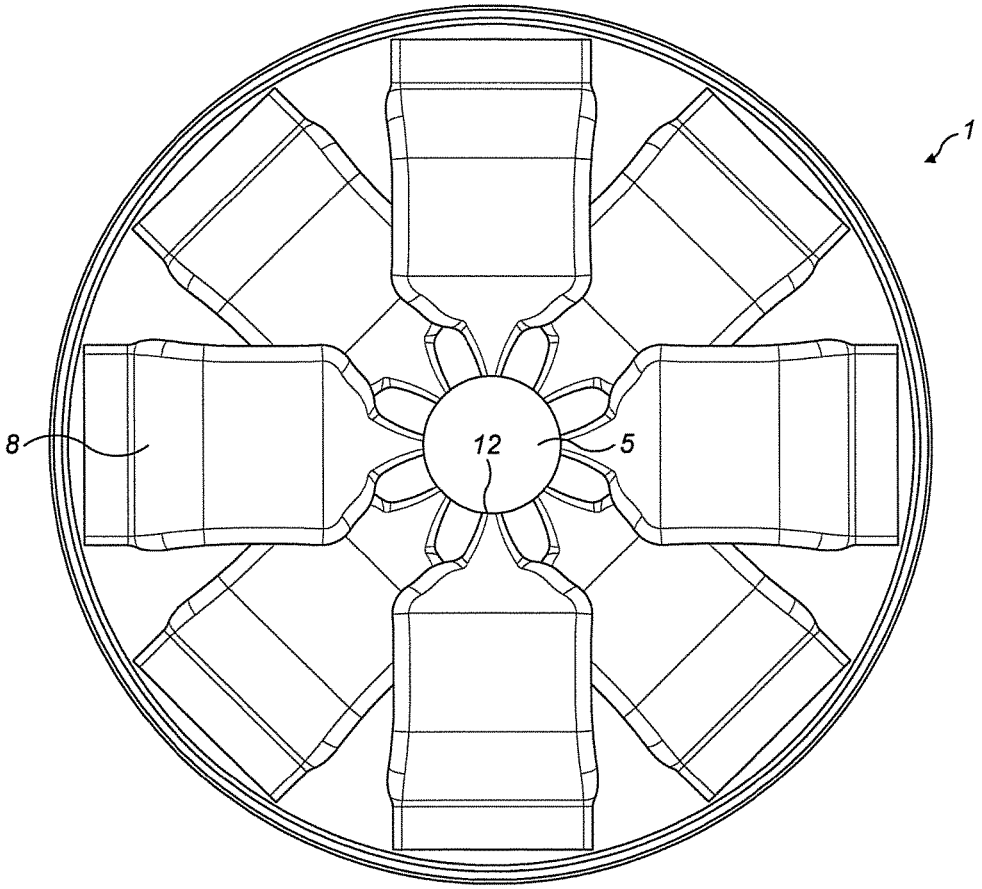
FIG. 8 shows a container according to the invention with individual smokeless tobacco pouches arranged about the pole in a flower formation. Each pouch is attached to the pole via a hole in the surface of the pole, into which one end of the pouch is inserted.

FIG. 7 shows an empty container (1) according to the invention, wherein the pole (5) has a plurality of holes (12) in its surface to enable pouches to be attached. FIG. 8 shows the container (1) with individual smokeless tobacco pouches (8) arranged about the pole (5) in a flower formation. Each pouch is attached to the pole via a hole (12) in the surface of the pole, into which one end of the pouch is inserted. When in use, a consumer can remove a pouch by pulling it away from the pole.

Figure 9:
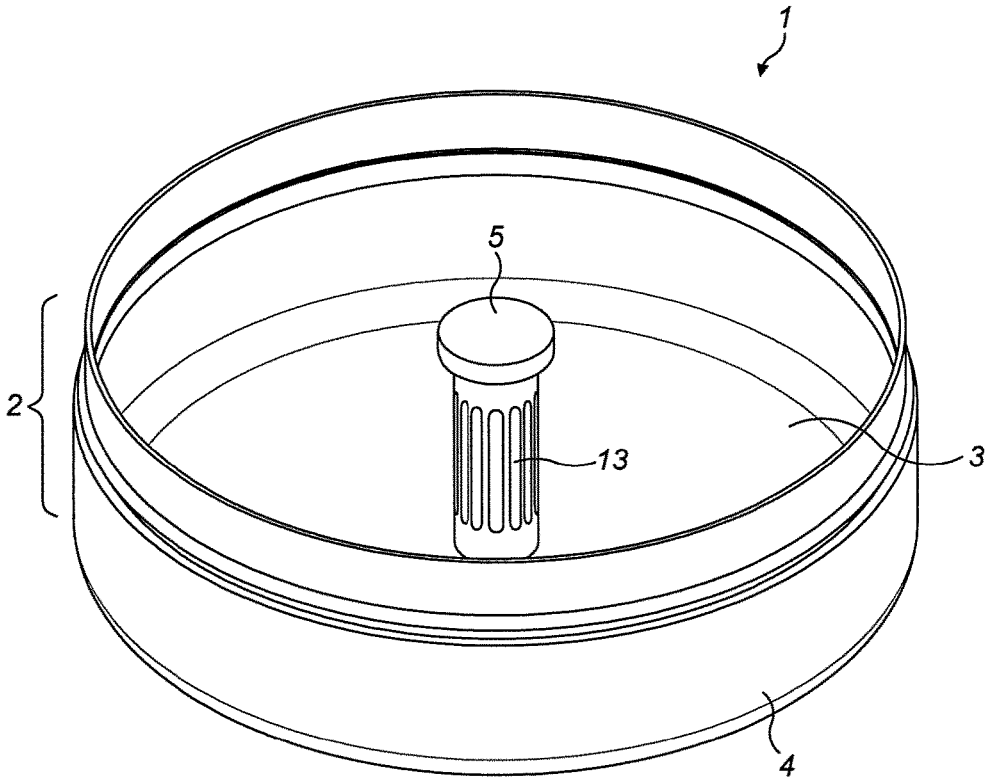
FIG. 9 shows an empty container according to the invention, wherein the central portion of the pole has a plurality of slots in to enable pouches to be attached to the pole.
Figure 10A:
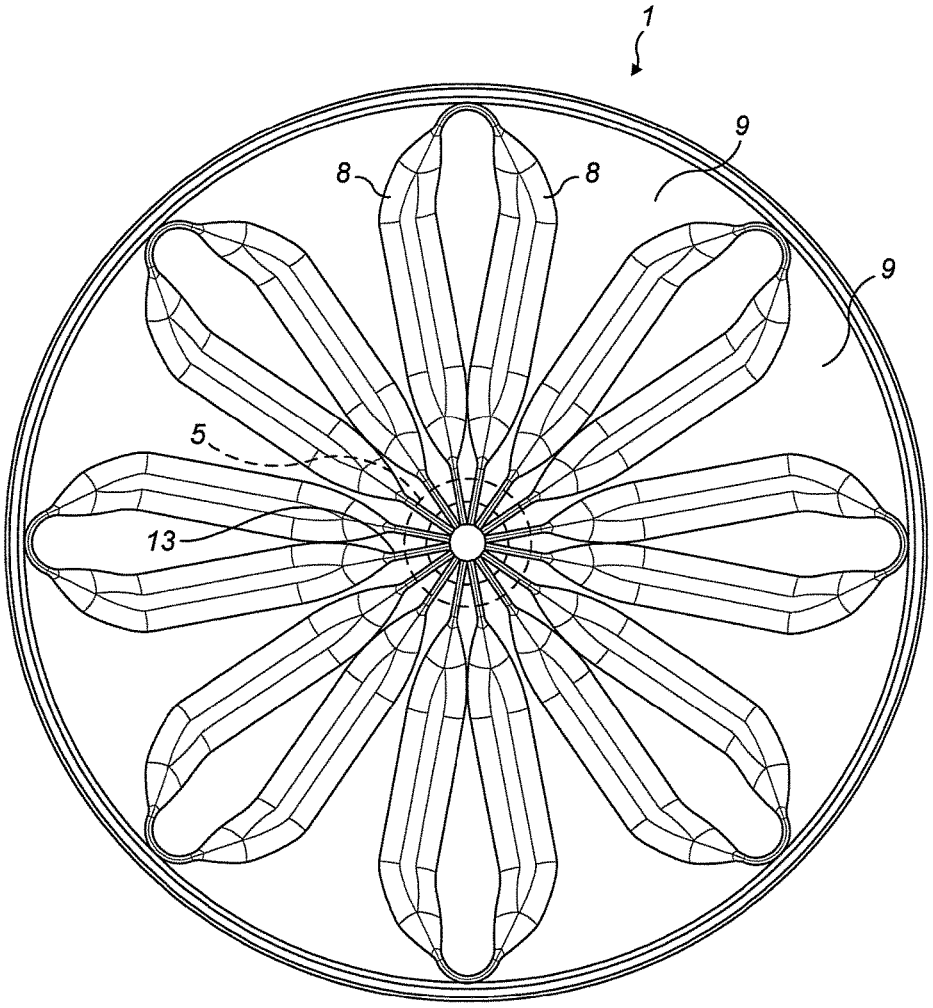
FIG. 10A shows a container according to the invention with individual smokeless tobacco pouches arranged about the pole. Each pouch is attached to the pole via a slot in the surface of the pole, into which one end of the pouch is inserted.

FIG. 9 shows an empty container (1) according to the invention, wherein the central portion of the pole (5) has a plurality of slots (13) to enable pouches to be attached to the pole. FIG. 10A shows the container (1) with individual smokeless tobacco pouches (8) arranged about the pole (5). Each pouch is attached to the pole via a slot (13) in the surface of the pole, into which one end of the pouch is inserted. In this embodiment, pouches are provided in pairs, with each pair connected via a perforated portion at the opposite end of the pouch from the end that is inserted into the slot in the pole.

In an alternative embodiment (not shown), pairs of pouches can be provided by connecting two pouches that are not positioned adjacent to each other within the container. For example, connected pouches may be positioned opposite each other in the container. The pouches can be connected via the portions of the pouches that are inserted into the slots in the pole.

Figure 10B:
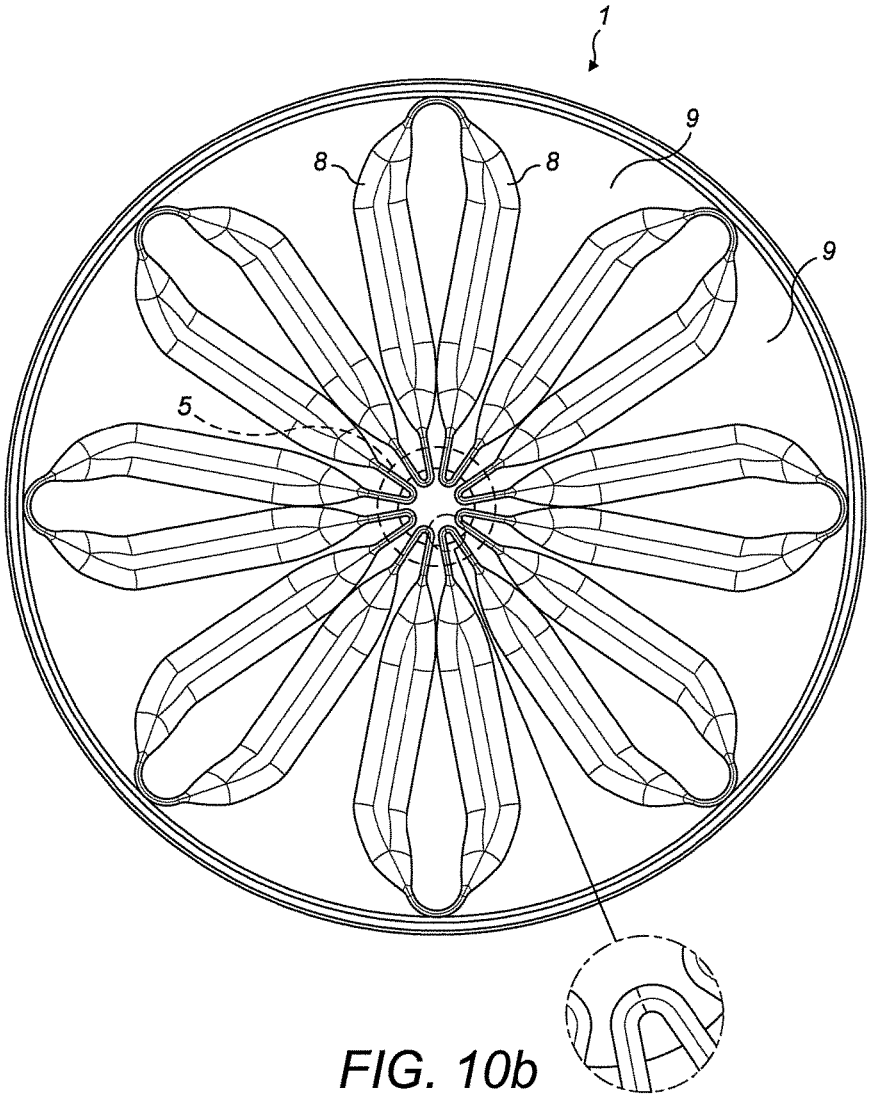
FIG. 10B shows an embodiment wherein the pouches are provided as a continuous strip. Each pouch is attached to the two adjacent pouches via a perforated portion at the end of the pouch that is inserted into the pole or at the end of the pouch that is not inserted into the pole.

FIG. 10B shows an embodiment wherein the pouches (8) are provided as a continuous strip (9). Each pouch is attached to each of the two adjacent pouches via a perforated portion at the ends of the pouches that are inserted into the pole or at the ends of the pouches that are not inserted into the pole.

Figure 11:
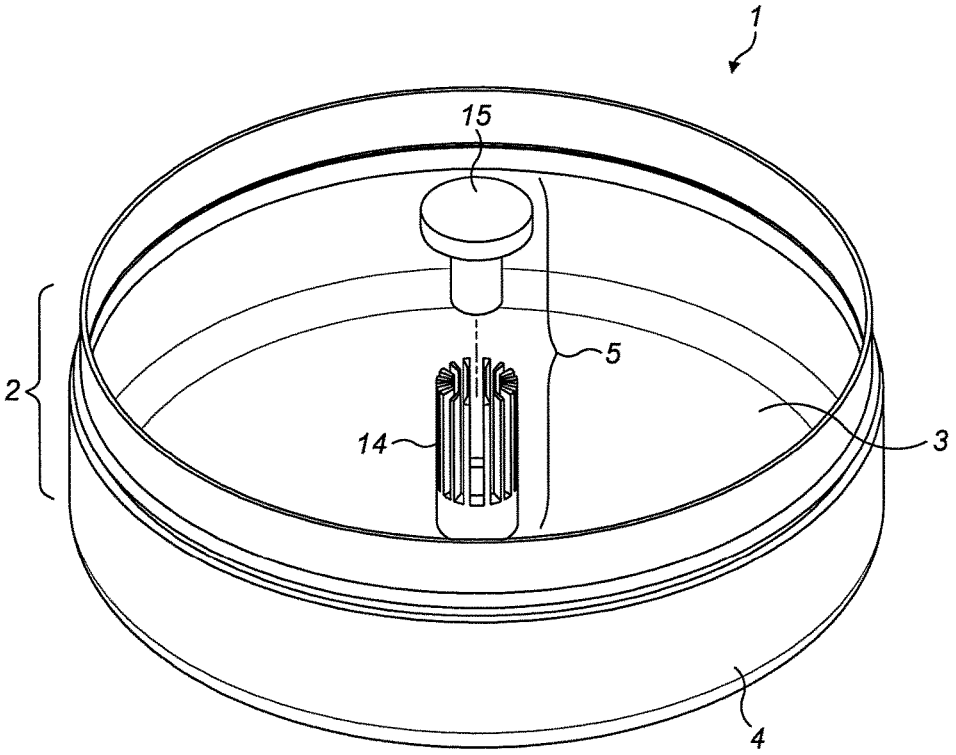
FIG. 11 shows an empty container according to the invention, wherein the top portion of the pole has a plurality of slots to enable pouches to be attached. The pole also comprises a plug portion.

FIG. 11 shows an empty container (1), wherein the top portion of the pole (5) has a plurality of slots (14) to enable pouches to be attached. The pole also comprises a plug portion (15), which is used to secure the pouches in place when they are inserted into the slots.

Figure 12A:
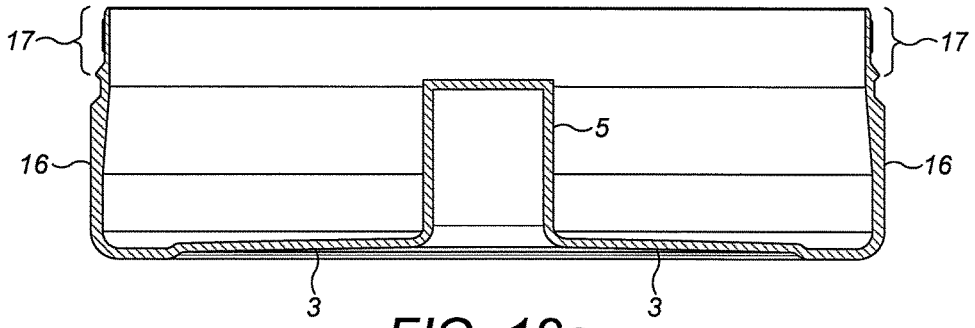
FIG. 12A shows a cross-sectional view of the base, in an embodiment wherein the pole is integral to the bottom portion and FIG. 12B show a plan view of the same embodiment of the invention.
Figure 12B:
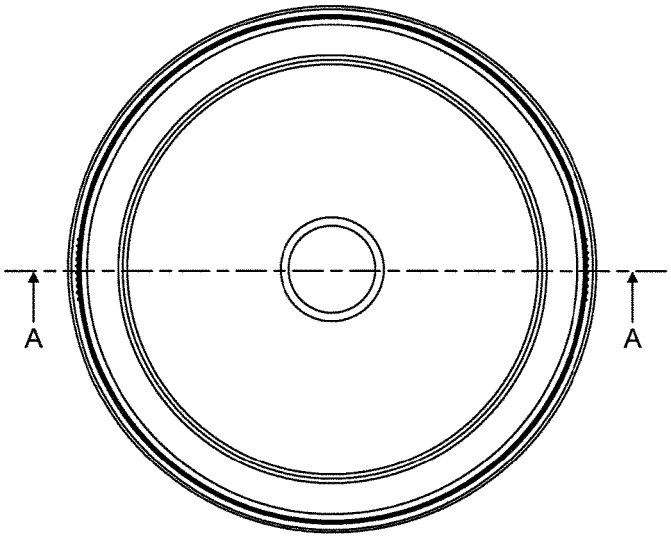

FIG. 12A is a cross-sectional view showing an embodiment of the invention wherein a hollow pole (5) is integral to the bottom portion (3) of the base. The thickness of the pole is equal to the thickness of the bottom portion of the base and also equal to the thickness of the lower portion of the sidewall portion (16). The consistent thickness of these components of the base is as it enables a simple and straightforward process for manufacturing the container of the invention. As shown in FIG. 12A, the thickness of the upper portion of the sidewall (17) is reduced, to enable a lid (not shown) to be positioned securely on top of the base. A plan view of the same embodiment is shown in FIG. 12B.

In other embodiments (not shown) wherein the pole is not integral to the base the thickness of the bottom portion is equal to the thickness of at least the lower portion of the sidewall portion. This achieves the same advantageous effect of enabling a simple and straightforward process for manufacturing the container of the invention.

The invention claimed is:

1. A container for smokeless tobacco comprising:
smokeless tobacco pouches;
a base having a bottom surface and a sidewall, and defining a cavity arranged to retain the smokeless tobacco pouches; and
a pole disposed within the cavity extending upward from the bottom surface, the pole having a first portion and a second portion wider than the first portion, the second portion positioned opposite the bottom surface, the pole being arranged such that the smokeless tobacco pouches are retained in a defined pattern.

2. A container for smokeless tobacco comprising:
smokeless tobacco pouches;
a base having a sidewall and a bottom surface, and configured to retain the smokeless tobacco pouches; and
a pole positioned centrally on the base and extending upward from the bottom surface and having an outer surface,
wherein the sidewall, the bottom surface, and the outer surface of the pole define an undivided cavity of the container in which the smokeless tobacco pouches are retained in a defined pattern.

3. The container according to claim 2, wherein at least two of the smokeless tobacco pouches are attached to the pole.

4. The container according to claim 2, wherein the smokeless tobacco pouches are attached to the pole using food grade glue.

5. The container according to claim 2, wherein the pole is cylindrical.

6. The container according to claim 2, wherein the pole is polygonal.

7. The container according to claim 6, wherein the smokeless tobacco pouches are attached to one or more surfaces of the polygonal pole.

8. The container according to claim 2, wherein the pole is integral to the base.

9. The container according to claim 2, wherein a longitudinal axis of the pole is substantially perpendicular to the base.

10. The container according to claim 2, wherein a height of the pole in a direction of a longitudinal axis of the pole is between 10 to 30 mm.

11. The container according to claim 2, wherein a shape of each pouch is rectangular having major panels and side panels, wherein the major panels are contacted to each other and/or wherein the side panels are contacted to the base.

12. The container according to claim 2, wherein the container further comprises a lid to close the cavity.

13. The container according to claim 7, wherein the tobacco pouches are attached to each surface of the polygonal pole.

14. The container according to claim 4, wherein the food grade glue is starch.

15. The container according to claim 2, wherein the smokeless tobacco pouches are attached to the pole by inserting a portion of the pouch into a hole or slot in a surface of the pole.

16. The container according to claim 2, wherein the bottom surface has a constant thickness.

17. A container for smokeless tobacco comprising;

smokeless tobacco pouches;

a base having a bottom surface having a constant thickness and a sidewall extending around the circumference of the bottom surface;

a pole extending upward from the bottom surface and having an outer surface, wherein the sidewall, the bottom surface, and the outer surface of the pole define an undivided cavity of the container in which the smokeless tobacco pouches are retained in a defined pattern.

18. The container according to claim 17, wherein the pole includes a first portion having a plurality of slots, each slot configured to retain a portion of at least one of the smokeless tobacco pouches within the slot.

* * * * *